US008561350B2

(12) United States Patent
Cardine et al.

(10) Patent No.: US 8,561,350 B2
(45) Date of Patent: Oct. 22, 2013

(54) BRACKET FOR WINDOW REGULATOR WINDOW REGULATOR AND VEHICLE BODY

(75) Inventors: Patrice Cardine, Orleans (FR); Denis Chevy, Neuvy en Sullias (FR)

(73) Assignee: Inteva Products France SAS (FR)

( * ) Notice: Subject to any disclaimer, the term of this patent is extended or adjusted under 35 U.S.C. 154(b) by 1814 days.

(21) Appl. No.: 10/511,119

(22) PCT Filed: Feb. 13, 2004

(86) PCT No.: PCT/FR2004/000334

§ 371 (c)(1),
(2), (4) Date: Mar. 17, 2005

(87) PCT Pub. No.: WO2004/076790

PCT Pub. Date: Sep. 10, 2004

(65) Prior Publication Data

US 2005/0155290 A1 Jul. 21, 2005

(30) Foreign Application Priority Data

Feb. 14, 2003 (FR) ..... 03 01816

(51) Int. Cl.
*E05D 15/10* (2006.01)

(52) U.S. Cl.
USPC ..... 49/212

(58) Field of Classification Search
USPC ..... 49/212, 348, 349, 352, 502
See application file for complete search history.

(56) References Cited

U.S. PATENT DOCUMENTS

| | | | | |
|---|---|---|---|---|
| 4,589,227 | A | 5/1986 | Bickerstaff | |
| 5,632,121 | A | 5/1997 | Handte et al. | |
| 5,855,095 | A * | 1/1999 | Dedrich et al. | 49/502 |
| 5,927,021 | A * | 7/1999 | Kowalski et al. | 49/502 |

FOREIGN PATENT DOCUMENTS

| | | |
|---|---|---|
| DE | 100 14 946 | 9/2001 |
| EP | 626283 A1 * | 11/1994 |
| FR | 2 776 574 | 10/1999 |

OTHER PUBLICATIONS

International Search Report dated Jul. 26, 2004.

* cited by examiner

*Primary Examiner* — Jerry Redman
(74) *Attorney, Agent, or Firm* — Cantor Colburn LLP

(57) ABSTRACT

A vehicle window regulator includes a fixing lug including a first part for fixing to a window guide rail having a window-guiding direction and a second part for fixing to a vehicle body. The second part defines a plane, and a normal line perpendicular to the plane that is inclined relative to the window-guiding direction. The normal line is preferably inclined at an angle of approximately 45° relative to the window-guiding direction. The lug can be fixed in the vehicle body without the lug turning on itself during fixing by screwing, for example.

21 Claims, 2 Drawing Sheets

BRACKET FOR WINDOW REGULATOR WINDOW REGULATOR AND VEHICLE BODY

REFERENCE TO RELATED APPLICATIONS

This application claims priority to PCT Application PCT/FRO4/000334 filed on Feb. 13, 2004, which claims priority to French Patent Application FR 03 01 816 filed on Feb. 14, 2003.

BACKGROUND OF THE INVENTION

This invention relates to a lug for fixing a window regulator, a window regulator and a vehicle body.

A problem can arise when fixing a window regulator in a vehicle door, in particular in a vehicle that does not have a frame around the window glass, for example a frameless door or a rear quarter window (a rear side panel of the body of the vehicle). The window glass is not guided by a frame, so the window regulator must be precisely so that the window glass enters the roof when in raised position. It must therefore be possible to adjust the rails by a rotation around an axis that is parallel to the direction of movement of the vehicle.

Citron company Produces a vehicle known as Pluriel, which proposes a solution. The rail is fixed into the bodywork with a lug. The lug includes a fixing part that is perpendicular to a circle having as an axis an upper rotation point and radius that is equal to a distance between the lug and the rotation axis. The lug rests on a bridge fitting in the door, and the bridge fitting has a surface that cooperates with the fixing part. A screw is inserted into the fixing part, parallel to the rail, allowing for the lug to be fixed to the surface of the bridge fitting. To prevent the lug and consequently the rail from rotating about themselves during screwing, the lug includes two fins on either side of the fixing part. The fins are inclined relative to the fixing part and cooperate with corresponding surfaces on the bridge fitting.

A drawback to this design is that the lug and the bridge fitting are complex and difficult to manufacture. Great precision is required in manufacturing to ensure they cooperate correctly with each other.

There is therefore a need for a lug for fixing a window regulator in a vehicle body that is simple to manufacture and prevents the lug from rotating on itself when it is fixed in the body.

SUMMARY OF THE INVENTION

The present invention provides a lug for fixing a window regulator, including a first part for fixing to a window guide rail having a window-guiding direction, and a second part for fixing to a vehicle body The second part defines a plane, and a line perpendicular to the plane is inclined relative to the guiding direction. According to one embodiment, the line perpendicular to the second part is inclined at an angle of approximately 45° relative to the window-guiding direction.

According to another embodiment, the first part and the second part are connected to each other by a connection that extends in a plane that is substantially perpendicular to the plane containing the guiding direction.

According to yet another embodiment, the second fixing part includes a hole and a member for fixing the lug on the vehicle body of that can pass through the hole. The hole is for example oblong.

The invention also provides a window regulator including a lug such as described previously, and a window guide rail defining a window-guiding direction, that carries the lug at one of its ends.

According to one embodiment, the window regulator also includes a window slide guided by the window guide rail. According to another embodiment, the window guide rail is a window runner.

The present invention also provides a body with the window regulator as described previously and a bridge fitting for fixing the window regulator in the body. For example, the bridge fitting has a surface, and a line perpendicular to the bridge fitting is inclined relative to the guiding direction.

Other characteristics and advantages of the invention will become apparent when reading the following detailed description of the embodiments of the invention, given as an example only and with reference to the drawings.

DETAILED DESCRIPTION OF PREFERRED EMBODIMENTS

The invention provides a lug for fixing a window regulator having a window-guiding direction. The lug includes a fixing part that extends in a plane that has a normal line N perpendicular to the plane that is inclined relative to the window-guiding direction. This allows the lug to be fixed in a vehicle body without the lug turning on itself during fixing by screwing for example. Moreover, the construction of the lug is simple because it includes only one part, and the normal line N is inclined relative to the guiding direction.

The coordinate system given on the Figures includes an axis Z that extends in the direction of the height of the vehicle, an axis X that extends along the direction of movement of the vehicle, and an axis Y that extends in a direction transverse to the vehicle, and perpendicular to the X and Z axes.

Figure 1:
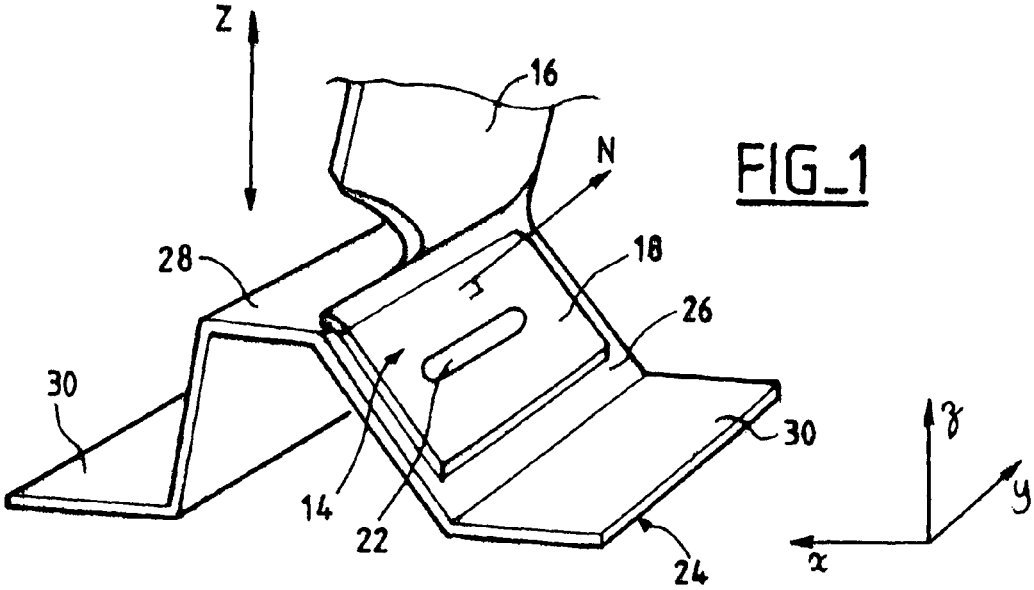
FIG. 1 shows a fixing lug according to the invention.
Figure 4:
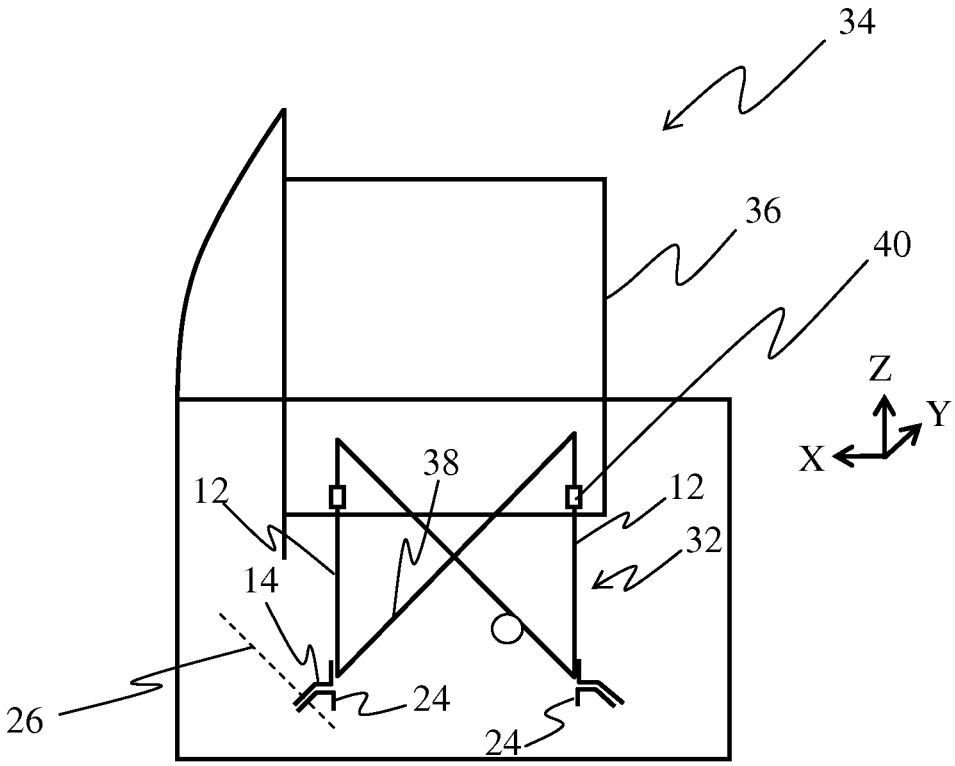
FIG. 4 shows a door including a window regulator and the lug.

FIG. 1 shows a fixing lug 14 according to an embodiment of the invention. As shown in FIG. 4, the lug 14 allows for the fixing of a window regulator 32 in a vehicle body 34 without a window frame. The term vehicle body 34 here means a vehicle door or a rear body panel. The lug 14 is, for example, fixed onto a bridge fitting 24 in the vehicle body 34. The vehicle body 34 includes a window glass 36 that is actuated by the window regulator 32. The window regulator 32 has a guiding direction that extends along the axis Z in the direction of the height of the vehicle. The window regulator 32 is, for example, a cable or mechanical arm window regulator. The window regulator 32 includes a window guide rail 12. The window guide rail 12 defines the guiding direction along the axis Z. Hereafter, and to simplify matters, it will be considered that the guiding direction Z is flat while the window glass 36 and the window guide rail 12 can be convex. The window guide rail 12 is, for example, a rail that guides a slide 40 drawn by a cable 38. The window guide rail 12 can also be a window runner into which the window glass 36 is fitted and runs in the vehicle body 34.

Referring to FIG. 1, the lug 14 for fixing the window glass 36 includes a first part 16 for fixing to the window guide rail which has the window-guiding direction and a second part 18 for fixing to the vehicle body 34. The second part 18 extends in a plane and a line extends substantially perpendicular to the plane (a normail line N) that is inclined relative to the guiding direction Z. [0020] The first part 16 of the lug 14 is fixed to the window guide rail 12.

The first part 16 includes a flat portion that is fixed to the window guide rail 12. The first part 16 of the lug 14 can be fixed to the window guide rail 12 by screwing or welding for example.

The second part of the lug 14 is fixed to the vehicle body 34. The second part 18 defines a plane that is inclined with respect to the flat portion of the first part 16 That is, the normal line N is not parallel to the guiding direction Z.

Figure 2:
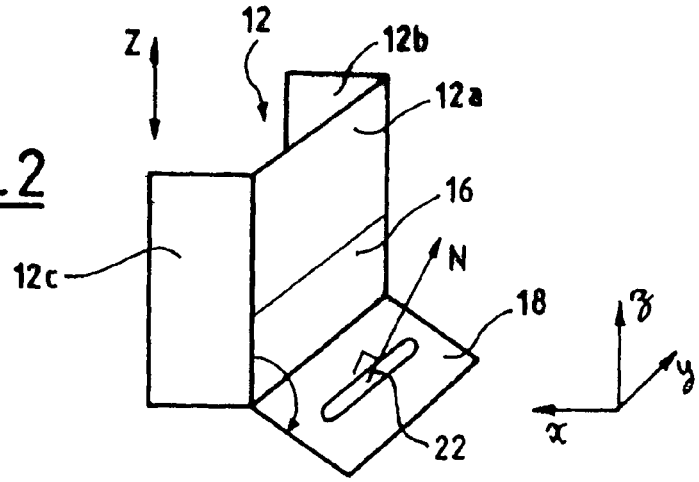
FIG. 2 shows a different embodiments of the lug.
Figure 3:
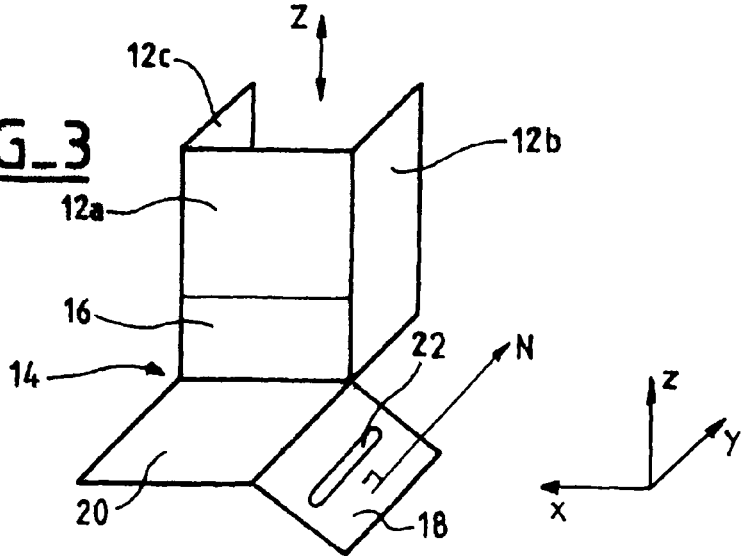
FIG. 3 shows a different embodiment of the lug in FIG. 1.

FIGS. 2 and 3 show different embodiments of the lug 14. The first part 16 and the second part 18 are obtained for example by pressing a steel plate. The first part 16 and the second part 18 can also be joined together by welding. In FIG. 2, the first part 16 and the second part 18 can be joined along an edge extending substantially along the Y axis. In FIG. 3, the first part 16 and the second part 18 can also be joined by a connection 20 that extends in a plane that is substantially perpendicular to the plane containing the guiding direction Z. In FIG. 3, the first part 16 is joined to the connection 20 along an edge extending along the axis X and the second part 18 is joined to the connection 20 along an edge extending along the axis Y. The connection 20 can be of any shape allowing the first part 16 and the second part 18 to be joined. For example, the connection 20 can have a twisted shape to join the planes containing the non-parallel first part 16 and the second part 18.

The window guide rail 12 has, for example, a U-shaped section with a bottom 12*a* from which lateral arms 12*b* and 12*c* extend. The window guide rail 12 can guide a slide 40 along one of the lateral arms 12 band 12*c*. The window glass 36 is then parallel to the bottom 12*a*. Alternatively, the window guide rail 12 can be a runner that guides the window glass 36 directly. The window glass 36 is inserted into the window guide rail 12 and runs along the window guide rail 12 in the vehicle body 34. The window glass 36 is then substantially perpendicular to the bottom 12*a*. The guiding direction corresponding corresponds to the axis Z of the coordinate system.

According to the embodiment shown in FIG. 2, the first part 16 and second part 18 meet along an edge extending along the Y axis. The first part 16 is connected to the bottom 12*a* of the window guide rail 12. The second part 18 of the lug 14 is inclined at an angle $\alpha$ that is greater than 90°, for example approximately 135°. The normal line N perpendicular to the plane that contains the this second part 18 is inclined at an angle of approximately 45° relative to the guiding direction Z of the window glass 36.

According to the other embodiment in FIG. 3, the first part 16 and second part 18 are connected by the connection 20. The connection 20 allows the window guide rail 12 to be oriented differently in the vehicle body 34 compared to the representation in FIG. 2 in order to adapt the orientation of the window guide rail 12 to the window-guiding mode in the vehicle body 34. The first part 16 is connected to the bottom 12*a* of the window guide rail 12. The normal line N that is perpendicular to the plane containing the second part 18 is inclined at an angle of approximately 45° relative to the window-guiding direction Z.

It can also be envisioned that the lug 14 can be fixed by the first part 16 to one of the lateral arms 12*b* and 12*c*.

Preferably, the second part 18 for fixing to the vehicle body 34 includes a fixing hole 22. A member that fixes the lug 14 onto the vehicle body 34 can pass through the fixing hole 22. The fixing member is, for example, a screw. The screw is screwed into the second part 18 in the direction of the normal line N. The screw penetrates a circular hole in a bridge fitting 24, and the screw can be self-tapping, or a nut can be crimped under the bridge fitting 24.

The second part 18 allows for the fixing of the window guide rail 12 in the vehicle body 34 without deforming the window guide rail 12. As the screw extends in the direction of the normal line N, which is inclined relative to the window-guiding direction Z, the torque exerted to tighten the screw is thus not exerted around the guiding direction Z. The tightening torque then does not cause the lug 14 to rotate around the guiding direction Z. Thus the window guide rail 12 of the window regulator 32 does not rotate around this direction either. Because of the lug 14, the fixing of the window glass 36 thus does not interfere with the guiding of the window glass 36.

According to one embodiment, the fixing hole 22 for the passage of the fixing member is substantially oblong. This allows the position of the window regulator 32 in the vehicle body 34 to be regulated by adjusting the position of the fixing member along the oblong fixing hole 22. Preferably, according to FIG. 1, the largest dimension of the oblong fixing hole 22 extends substantially along the Y axis. This allows the position of the window regulator 32 to be regulated transversally to the direction of movement of the vehicle. The window regulator 32 can be adjusted precisely for the window glass 36 to enter into the roof in its raised position.

The lug 14 can also be integral with the window guide rail 12. The lug 14 is formed at one end of the window guide rail 12, thus reducing the number of parts. The flat portion of the first part 16 is then formed with the end of the window guide rail 12.

The lug 14 allows for the fixing of the window regulator 32 in the vehicle body 34, either in a rear body panel or a vehicle door. The lug 14 can for example allow for the fixing of the upper or lower end of the window guide rail 12. According to FIG. 1, the lug 14 is located at the lower end of the window guide rail 12. The lug 14 is fixed to the bridge fitting 24. The bridge fitting 24 is for example a steel plate that is pressed to give it a shape to cooperate with the lug 14. The bridge fitting 24 and the lug 14 are, for example, located at the lower end of the window guide rail 12, the upper end of the window guide rail 12 can be fixed in a conventional way to the shell.

The bridge fitting 24 has a surface 26 that cooperates with the second part 18 of the lug 14. For this purpose the normal line N to the surface 26 is inclined with respect to the window-guiding direction Z. The surface 26 can include a hole for the passage of the fixing member opposite the fixing hole 22 for fixing the lug 14. The hole in the bridge fitting 24 can be substantially oblong regulate the position of the window regulator 32 in the vehicle body 34. Thus, the production of the bridge fitting 24 is simplified because only the surface 26 is produced accurately to cooperate with the second part 18 of the lug 14.

Preferably the connection 20 does not cooperate with the bridge fitting 24 for fixing the lug 14. The lug 14 is only fixed to the bridge fitting 24 by the second part 18. This avoids a hyperstatic connection needed between the bridge fitting 24 and the lug 14. It also simplifies the production of the bridge 24 fitting and the lug 14 because only one surface of each one cooperates with the other to immobilize the lug 14 in the vehicle body 34.

The bridge fitting 24 can also include two tabs 30 for fixing the bridge fitting to the 24 shell of the body.

The orientation of the bridge fitting 24 depends on of the orientation of the window guide rail 12 and the lug 14. Preferably the bridge fitting 24 is orientated as shown in FIG. 1, with the normal line N to the surface 26 in the plane of the axes X and Z, i.e., in the plane of movement of the vehicle. The largest dimension of the bridge fitting 24 preferably extends in the direction of movement of the vehicle, which avoids having to increase the depth of the shell of the vehicle body 34 in the direction transverse to the direction of movement.

This invention, is of, course not limited to the embodiments described as an example. Thus, the vehicle body 34 is not limited to vehicle bodies that do not have a frame around the window glass 36. The fixing lug 14 is not limited to the forms described. The fixing described is not limited to the fixing of window guide rails 12, but extends also to the fixing of a plate including slide runners. Moreover, the oblong fixing hole 22 is not limited to its combination with the described form of the fixing lug 14.

The foregoing description is only exemplary of the principles of the invention. Many modifications and variations of the present invention are possible in light of the above teachings. The preferred embodiments of the invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A vehicle body comprising:

a window regulator including:

a lug for fixing the window regulator;

a guide rail defining a window-guiding direction, the guide rail including ends, wherein the guide rail carries the lug at one of the ends; and a bridge fitting for fixing the window regulator in the vehicle body, wherein the lug includes a first part for fixing to the guide rail, and a second part defining a plane fixed by screwing onto the bridge fitting, a screwing direction being a normal line substantially perpendicular to the plane, and the normal line is inclined relative to the window-guiding direction.

2. The vehicle body according to the claim 1, wherein the bridge fitting includes a surface, and the normal line is substantially perpendicular to the surface.

3. The vehicle body as recited in claim 1, wherein the normal line and the window-guiding direction are non-parallel.

4. The vehicle body as recited in claim 1, wherein the second part is a planar portion.

5. A window regulator comprising:

a lug carried by a window regulator, the lug including:

a first part for fixing to a guide rail, the guide rail defining a window-guiding direction, and a second part for fixing to a vehicle body, the second part defining a plane fixed by screwing onto the vehicle body of a vehicle, a screwing direction being a normal line substantially perpendicular to the plane, wherein the normal line is inclined relative to the window-guiding direction.

6. The window regulator according to claim 5, wherein the normal line is inclined at an angle of approximately 45° relative to the window-guiding direction.

7. The window regulator according to claim 5, wherein the first part and the second part are connected to each other by a connection that extends in a plane substantially perpendicular to a plane containing the window-guiding direction.

8. The window regulator according to claim 7, wherein the second part includes a hole for the passage of a member for fixing the lug onto the vehicle body.

9. The window regulator according to claim 8, wherein the hole is substantially oblong.

10. The window regulator as recited in claim 8, wherein the hole is completely surrounded by material of the second part.

11. A window regulator according to claim 5, wherein the guide rail has ends, and the guide rail carries the lug at one of the ends.

12. The window regulator according to claim 11, further including a window slide guided by the guide rail.

13. The window regulator according to claim 11, wherein the guide rail is a window runner.

14. The window regulator as recited in claim 11, wherein the normal line and the window-guiding direction are non-parallel.

15. The window regulator as recited in claim 11, wherein the second part is a planar portion.

16. The window regulator as recited in claim 5, wherein the normal line and the window-guiding direction are non-parallel.

17. The window regulator as recited in claim 5, wherein the second part is a planar portion.

18. The window regulator as recited in claim 5, wherein the normal line is non-parallel and non-perpendicular to the window-guiding direction.

19. The window regulator as recited in claim 5, wherein an entirely of the second part of the lug is flat and planar.

20. The window regulator as recited in claim 5, wherein no part of the second part of the lug is located outside of the plane.

21. The window regulator as recited in claim 5, wherein the second part contacts the vehicle body.

* * * * *